United States Patent [19]

Akino et al.

[11] Patent Number: 4,574,607

[45] Date of Patent: Mar. 11, 1986

[54] CAN END SEAMING TOOL

[75] Inventors: Kenichiro Akino, Sendai; Akira Miura, Shimizu, both of Japan

[73] Assignees: Kyocera Corporation, Kyoto; Daiwa Can Company, Limited, Tokyo, both of Japan

[21] Appl. No.: 575,847

[22] Filed: Feb. 1, 1984

[30] Foreign Application Priority Data

Feb. 3, 1983 [JP] Japan ..... 58-16800

[51] Int. Cl.[4] ..... B21D 51/30

[52] U.S. Cl. ..... 72/112; 72/124; 72/207; 72/476; 413/27

[58] Field of Search ..... 29/132; 72/112, 120, 72/124, 467, 199, 207, 476; 76/DIG. 11; 413/27, 31

[56] References Cited

U.S. PATENT DOCUMENTS 3,916,497 11/1975 Doi et al. ..... 72/467 X
4,228,673 10/1980 Scheel ..... 72/467

FOREIGN PATENT DOCUMENTS 56-165539 5/1981 Japan .
56-165540 5/1981 Japan .
56-165541 5/1981 Japan .
55-53836 5/1981 Japan .
57-44435 3/1982 Japan .

*Primary Examiner*—E. Michael Combs
*Attorney, Agent, or Firm*—Wenderoth, Lind & Ponack

[57] ABSTRACT

A can and seaming tool for use in seaming a can end to a can body and having a seaming chuck and a seaming roll, said seaming chuck being adapted to fit said can end while said seaming roll is adapted to simultaneously press and seam the curling portion of said can end and the flanging portion of said can body, wherein the improvement comprises that at least one of said seaming chuck contacting said can end and the portion of said seaming roll frictionally contacting at least said can end is made from cermet of titanium carbonitride system (a composite sintered material composed of a metal and ceramics containing titanium carbides and titanium nitrides).

16 Claims, 5 Drawing Figures

CAN END SEAMING TOOL

FIELD OF THE INVENTION

The present invention relates to a seaming tool adapted for use in seaming a can end to a can body and having a seaming chuck and a seaming roll.

BACKGROUND OF THE INVENTION

Usually, the can end 2 of an ordinary packed can is seamed to a can body through a pre-seaming step conducted by a first seaming roll as shown in FIG. 1 and a final seaming step conducted by a second seaming roll 5.

More specifically, the seaming is conducted in accordance with the following process. As shown in FIG. 1, the can body 1 is mounted on a lifter plate 6 and the can end 2 is mounted on the can body 1. Then, as shown in FIG. 2, the seaming chuck 3 is fitted in the recessed part of the can end 2 so as to clamp the can body 1 and the can end 2. Then, the seaming chuck is rotated around the axis of the can body and, as shown in FIG. 3 the first seaming roll 4 rotatably mounted a shaft 13 parallel to the can axis 15 is moved towards the can axis, thereby to bring the annular groove 11 of the first seaming roll into contact with the curling portion 9 of the rotating can end 2. Consequently, the rotation of the can end 2 is transmitted through friction to the first seaming roll 4 to rotate the latter in synchronism with the rotation of the can end 2. Consequently, the curling portion 9 and the shoulder portion 8 connected to the curling portion 9 is turned and rolled into the shape of the annular groove 11 of the first seaming roll 4 as shown in FIG. 3, thereby to complete the pre-seaming by the first seaming roll 4. Then, the first seaming roll 4 is separated from the can end and the second seaming roll 5, which is rotatably carried by a shaft 14 parallel to the can axis 15, is moved towards the can axis while the latter is held vertically. Then, as in the case of the first seaming roll 4, an annular groove 12 in the second seaming roll 5 is brought into pressure contact with the curling portion 9 of the rotating can end 2, thereby to frictionally drive the second seaming roll 5 in synchronism. Consequently, the curling portion 9 and the shoulder portion 8 connected to the curling portion 9 are turned and rolled in confirmity with the annular groove 12 in the second seaming roll 5 into the state as shown in FIG. 5 thereby to complete the seaming.

As has been described, the seaming chuck and the seaming roll are made to contact with the can lid so as to be frictionally driven by the latter in synchronism with the same. The friction between the can end and the seaming chuck and seaming roll takes place not only during the synchronous rotation but also before and after the synchronous rotation, i.e. when the apparatus is being started and stopped. Consequently, the friction surfaces of the seaming chuck and the seaming roll are worn down rapidly. The rate of wear is increased as the seaming speed is increased. The friction surface coarsened by wearing damages the coating film on the can end surface to make the same come off from the can end surface. This not only impairs the appearance due to rusting but also promotes the corrosion of the can body. In the worst case, the can body is perforated by corrosion to permit the contents to flow out of the can. Consequently, the can body is contaminated and the content is lost. In order to obviate this problem, it is necessary to renew the seaming tool, thereby incurring an increase in production cost. In addition, the renewal of the seaming tool necessitates a suspension of the operation of the production line which unfavorably impairs the achievement of the production plan.

As a measure for overcoming these problems of the prior art, it has been proposed to use a hard alloy having a large wear resistance as the material of the seaming tool. This measure, however, cannot overcome the problems satisfactorily.

Under these circumstances, various proposals have been made up to now, as in Japanese Utility Model Laid-Open No. 165539/1981, Japanese Utility Model Laid-Open No. 165540/1981, Japanese Utility Model Laid-Open No. 165541/1981 and Japanese Patent Laid-Open No. 44435/1982. Some of these proposals use TiC or TiN solely or in the form of a solid solution. Namely, in these proposals, the tool surface is coated with a layer of TiC or TiN by chemical evaporation method. This coating layer, however, is extremely thin and can withstand only a short use.

OBJECT OF THE INVENTION

Accordingly, the present invention has, as its primary object, to overcome these problems of the prior art.

SUMMARY OF THE INVENTION

To this end, according to the invention, there is provided a can end seaming tool for use in seaming a can end to a can body and having a seaming chuck and a seaming roll, the seaming chuck being adapted to fit the can end while the seaming roll is adapted to simultaneously press and seam the curling portion of the can end and the flanging portion of the can body, wherein the improvement comprises that at least one of the seaming chuck contacting the can end and the portion of the seaming roll frictionally contacting at least the can end is made from cermet of titanium carbonitride system (a composite sintered material composed of a metal and ceramics containing titanium carbides and titanium nitrides).

DETAILED DESCRIPTION OF THE INVENTION

The invention will be described in more detail hereinunder through preferred embodiments.

The composition of the titanium carbonitride system cermet used in the invention consists essentially of 55 to 95 wt % of TiC-TiN ceramic composition and 5 to 45 wt % of binding metal, preferably 70 to 90 wt % of ceramic composition and 10 to 30 wt % of binding metal.

TiC is added to improve the wear resistance of the cermet material. The TiC content is preferably selected to range between 10 and 60 wt %.

On the other hand, TiN serves as an inhibitor for inhibiting the growth of TiC crystal grain, thereby to further increase the wear resistance and also to contribute to the improvement in the hardness and toughness. Preferably, the TiN content is selected to be 5 to 30 wt % of the cermet composition.

It is possible to add one or more additives, such as one or more selected from carbides such as $Mo_2C$, NbC, WC and the like and nitrides such as TaN, ZrN and so forth.

With these additives, it is possible to improve the properties correspondingly. Above all, the addition of 5 to 30 wt % of $Mo_2C$ improves the wettability of the cermet with the binding metal and, hence, to increase the sinterability. On the other hand, the addition of 10 to 40 wt % of NbC further increases the wear resistance effectively.

At least one of iron group metals including Fe, Ni and Co is selected as the binding metal. It is, however, possible to use an alloy formed of the iron-group alloy and chromium-group alloy (Cr, Mo or W).

A practical example of the method of producing the invented seaming tool will be described hereinunder. At first, a suitable crushing medium such as acetone is added to a mixture material containing the ceramics component such as TiC, TiN or the like and the binding metal component, and the mixture is then crushed by a vibration mill. The crushed mixture is then dried and, after the removal of the solvent, pulverized and passed through 50 to 100 mesh screen to become the material for the cermet.

Figure 1:
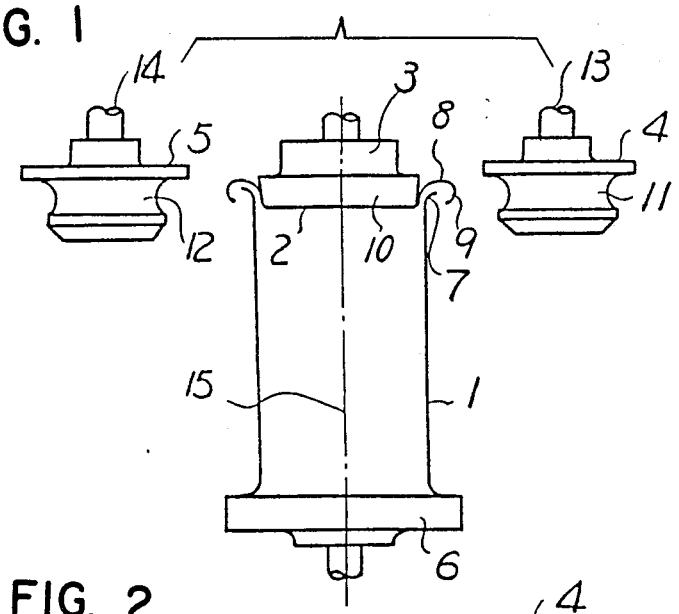
FIG. 1 is a schematic illustration of a seaming chuck and seaming rolls incorporated in a can end seaming tool.
Figure 2:
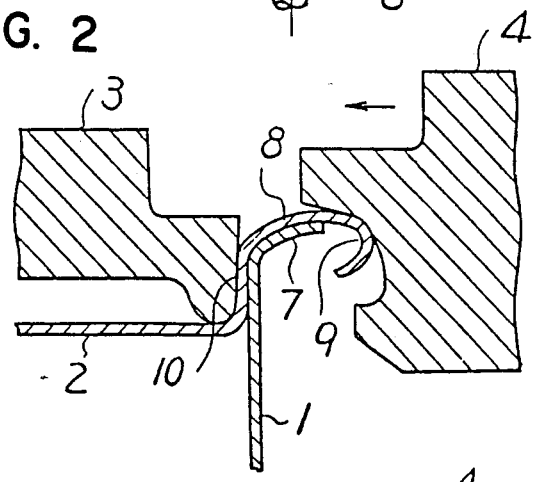
FIGS. 2 to 5 are illustrations showing the state of proceed of the seaming work.
Figure 3:
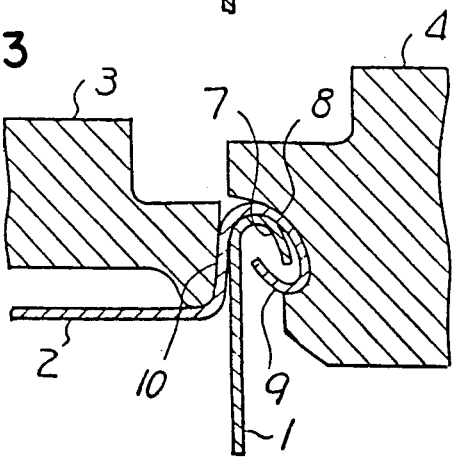
Figure 4:
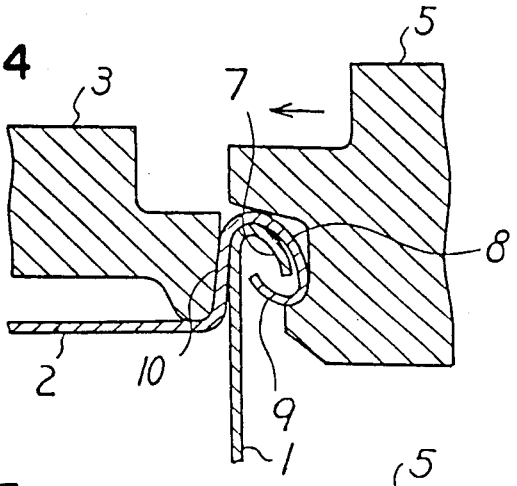
Figure 5:
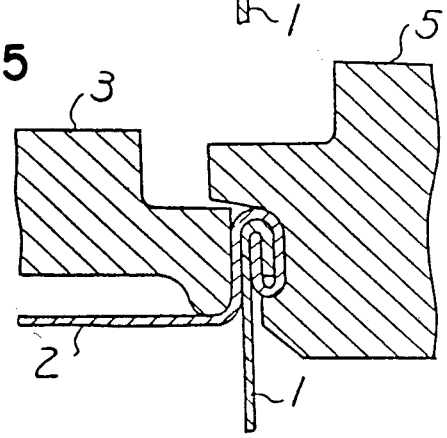

This material is then compressed and shaped and is fired in a non-oxidizing atmosphere at a temperature of 1400° to 1500° C. to become a sintered body. Then, the seaming chuck 3 shown in FIG. 1 and seaming rolls 4, 5 as shown in the same Figure are obtained through grinding and polishing the sintered body.

An explanation will be made hereinunder as to an example of the use of the seaming tool in accordance with the invention.

(1) Seven kinds of seaming tools were produced from titanium carbonitride system cermets having the compositions as shown in Table 1 below. These seven classes of seaming tool are expressed as sample Nos. 1 to 7. By way of reference, three classes of seaming tools represented by sample Nos. 8, 9 and 10 were prepared. These three classes of seaming tools were made from three different hard alloys mainly consisting of tungsten carbides a part of which substituted by titanium carbide with the addition of cobalt as the binder.

(2) Testing Condition

Seaming tool Used: high-pressure seaming tool 1200 cans/min

Seaming speed per head: 100 cans/min

Type of can used in test: Tomato juice packed can

Can end material: TFS Plate thickness 0.21 mm, Counter sink 4 mm (3) Test result The periphery of the seamed portion of the seamed can end of the product can was dipped in $CuSO_4$ for 3 minutes. While the total number of the product cans is still small, no separation of the coating film was observed. However, as the number grows large, the cans came to exhibit separation of the coating film to expose the iron surface. The iron was rusted in red as a result of reaction with $CuSO_4$. The time length until the circumferential length of the red-rusted portion reaches ¼ of the overall circumferential length of the seamed portion was determined as the life of the seaming roll.

The lives of the seaming rolls employed in the test were as shown in Table 2 below.

TABLE 1

(compositions of cermets used in the invention and hard alloys for comparisons)

| Sample | Compositions (wt %) | | | | | | |
|---|---|---|---|---|---|---|---|
| | TiC | TiN | $Mo_2C$ | NbC | WC | Ni | Co |
| 1 | 45 | 15 | 10 | 10 | | 20 | |
| 2 | 55 | 20 | 10 | | 5 | 5 | 5 |
| 3 | 40 | 10 | 10 | 20 | 5 | 10 | 5 |
| 4 | 50 | 20 | 10 | | 10 | 5 | 5 |
| 5 | 45 | 15 | 20 | | 5 | 10 | 5 |
| 6 | 20 | 10 | 10 | 30 | 15 | 10 | 5 |
| 7 | 40 | 30 | 10 | | 10 | 5 | 5 |
| 8 | 30 | | 10 | | 50 | | 10 |
| 9 | 20 | | | | 70 | 5 | 5 |
| 10 | | | | | 95 | | 5 |

TABLE 2

| Sample Nos. | Life of seaming rolls |
|---|---|
| 1 | $249 \times 10^4$ |
| 2 | $335 \times 10^4$ |
| 3 | $435 \times 10^4$ |
| 4 | $390 \times 10^4$ |
| 5 | $310 \times 10^4$ |
| 6 | $415 \times 10^4$ |
| 7 | $365 \times 10^4$ |
| 8 | $78 \times 10^4$ |
| 9 | $72 \times 10^4$ |
| 10 | $65 \times 10^4$ |

EFFECT OF THE INVENTION

As will be understood from Table 2, the seaming rolls of the invention (Sample Nos. 1 to 7) made from cermets of titanium carbonitride group can withstand at least 2,490,000 seaming cycles, i.e. cans, and up to 4,350,000 seaming cycles (cans). This number is much greater than the maximum life of the conventional seaming roll made of hard alloy. Thus, the seaming roll of the invention made from titanium carbonitride cermets can stand a use which is 3.2 to 5.5 times as long as that of the conventional seaming roll.

We claim:

1. A can end seaming tool for use in seaming a can end to a can body and comprising a seaming chuck and a seaming roll, said seaming chuck being adapted to fit said can end while said seaming roll is adapted to simultaneously press and seam a curling portion of said can end and a flanging portion of said can body, and wherein the material of at least a body portion of said seaming chuck which frictionally contacts the can end and/or the material of at least a body portion of said seaming roll which frictionally contacts the can end consists essentially of a sintered cermet composed of 55 to 95 wt % of a TiC-TiN ceramic composition and 5 to 45 wt % of binding metal.

2. The can end seaming tool according to claim 1 wherein said TiC-Tin ceramic composition contains TiC, TiN and one or more members selected from the group consisting of $Mo_2C$, NbC, WC, TaN and ZrN.

3. The can end seaming tool according to claim 1 wherein said binding metal is one or more members selected from the group consisting of iron family metals (Fe, Ni Co) and alloys of said iron family metals with chromium family metals (Cr, Mo, W).

4. The can end seaming tool according to claim 2 wherein said binding metal is one or more members selected from the group consisting of iron family metals (Fe, Ni, Co) and alloys of said iron family metals with chromium family metals (Cr, Mo, W).

5. The can end seaming tool according to claim 1 wherein said sintered cermet contains 10 to 60 wt % of TiC.

6. The can end seaming tool according to claim 2 wherein said sintered cermet contains 10 to 60 wt % of TiC.

7. The can end seaming tool according to claim 3 wherein said sintered cermet contains 10 to 60 wt % of TiC.

8. The can end seaming tool according to claim 1 wherein said sintered cermet contains 5 to 30 wt % of TiN.

9. The can end seaming tool according to claim 2 wherein said sintered cermet contains 5 to 30 wt % of TiN.

10. The can end seaming tool according to claim 3 wherein said sintered cermet contains 5 to 30 wt % of TiN.

11. The can end seaming tool according to claim 1 wherein said sintered cermet contains 5 to 30 wt % of $Mo_2C$.

12. The can end seaming tool according to claim 2 wherein said sintered cermet contains 5 to 30 wt % of $Mo_2C$.

13. The can end seaming tool according to claim 3 wherein said sintered cermet contains 5 to 30 wt % of $Mo_2C$.

14. The can end seaming tool according to claim 1 wherein said sintered cermet contains from 10 to 40 wt % of NbC.

15. The can end seaming tool according to claim 2 wherein said sintered cermet contains from 10 to 40 wt % of NbC.

16. The can end seaming tool according to claim 3 wherein said sintered cermet contains from 10 to 40 wt % of NbC.

* * * * *